United States Patent [19]

Harper et al.

[11] Patent Number: 4,630,427

[45] Date of Patent: Dec. 23, 1986

[54] METHOD AND SYSTEM FOR FOLDING FLOPPY DISK ENVELOPES

[75] Inventors: Bruce Harper, San Jose; Horace N. Kemp, Walnut Creek, both of Calif.

[73] Assignee: Xidex Corporation, Santa Clara, Calif.

[21] Appl. No.: 734,621

[22] Filed: May 15, 1985

[51] Int. Cl.[4] ..... B65B 11/48

[52] U.S. Cl. ..... 53/460; 53/462; 53/206; 53/207; 53/209

[58] Field of Search ..... 53/460, 462, 206, 207, 53/209; 493/228, 229, 230, 231, 233, 235, 238, 242, 355

[56] References Cited

U.S. PATENT DOCUMENTS

| | | | |
|---|---|---|---|
| 1,268,674 | 6/1918 | Brown | 493/229 |
| 1,941,412 | 12/1933 | Nichols | 493/235 X |
| 2,136,823 | 11/1938 | Pierce | 53/460 X |
| 2,346,044 | 4/1944 | Nadeau | 53/460 |
| 3,628,304 | 12/1971 | Hornung | 53/460 |
| 3,908,524 | 9/1975 | Shore | 493/229 |
| 4,447,218 | 5/1984 | Bertsch | 493/242 X |

*Primary Examiner*—John Sipos

*Attorney, Agent, or Firm*—Townsend & Townsend

[57] ABSTRACT

A method and system are provided for folding floppy disk envelopes. Envelope blanks are manipulated while attached to a continuous web of envelope material to facilitate handling and alignment of the blanks. Initially, fold lines are prescored into the envelope blanks to define the precise dimensions of the envelope. Envelope flaps are then partially folded to define a receptacle into which the disk media is then inserted. The remaining flaps are then folded and sealed, and lastly the folded envelope is detached from the continuous web.

8 Claims, 30 Drawing Figures

METHOD AND SYSTEM FOR FOLDING FLOPPY DISK ENVELOPES

BACKGROUND OF THE INVENTION

1. Field of the Invention

The present invention relates generally to machines and methods for the forming and sealing of envelopes, and more particularly to a machine for folding and inserting disks into floppy disk envelopes.

2. Description of the Prior Art

Envelopes used for encasing floppy disks are typically formed from a plastic film material having a non-woven fabric liner for protecting the disk media. Heretofore, such envelopes have been folded from precut envelope blanks which are transported individually among various folding and sealing stations on one or more folding machines. Frequently, a first folding apparatus is provided for transversely folding the envelope blank in half and sealing two flaps along the sides, leaving an open end opposite the transverse fold. The partially folded envelope is then taken to a second apparatus where the disk media is inserted and the end envelope flap folded and sealed.

The manipulation of single pre-cut envelope blanks presents a number of problems. The blanks must be advanced sequentially among various folding, disk insertion, and sealing stations, usually requiring complex systems of grippers and suction devices. Moreover, intermachine transfers are most often accomplished manually, requiring labor and often slowing down the folding process. The most serious drawback with the prior art folding machines, however, has been the difficulty in properly aligning the envelope blanks so that the dimensions of the resulting envelopes are precisely controlled.

Because the envelope holds the disk in place while the disk is being read, it is important that the dimensions of the jacket be maintained within very close tolerances. It is also critical that the folds be made accurately in order to assure that the folded envelope remains absolutely flat after the folds have been sealed. The task of folding these envelopes is further complicated when envelope holes are precut envelope blanks. The holes in such precut envelope blanks must be accurately aligned after folding is complete.

Because of these requirements, complex aligning systems have been provided in prior art machines to assure that the envelope blank is properly positioned at each folding station. Any misalignment of the envelope blank might render useless the final folded product. To prevent misalignment, prior art machines utilize one or more flat mandrils for holding the envelope blank while it is folded in half and while the side flaps are sealed. The mandril acts as a form and the jacket is folded around the mandril. Thus, any slight misalignment of the equipment will result in mis-shaped envelopes. Moreover, the mandrils are frequently used to transport the partially folded envelope blank to a gluing or heat sealing station, thus preventing insertion of disk media during the envelope folding operation.

In view of the above, it would be desirable to develop novel methods and systems for folding floppy disk envelopes to facilitate the proper placement of fold lines in the folded product. It would be particularly desirable if such methods and systems allowed for insertion of the disk media into the envelope during the folding process and complete sealing of the envelope before the folded product was discharged from the machine.

SUMMARY OF THE INVENTION

The present invention provides a method and system for folding floppy disk envelopes while the envelopes are present on a continuous roll or web of envelope material. As the web is advanced among a plurality of folding and sealing stations, the envelopes are folded from partially-cut blanks which are formed in the web. The blanks, however, remain secured to the web through precisely located attachment points which allow the complete folding of the envelope without detachment of the blank from the web. After the folding of the envelope is complete, the attachment points are severed and the folded envelopes are removed from the web.

Accurate folding is accomplished by scoring or embossing the partially-cut envelope blank in a pattern corresponding to four orthogonal fold lines which define the final configuration of the jacket. The scoring is performed by a single scoring die which assures that the fold lines are precisely located on the jacket. When the jacket is advanced to subsequent folding stations, any minor misalignment of the envelope blank which may occur at those stations will have no effect on the folding which is defined solely by the score lines. Such accuracy is in contrast to the prior art where the alignment of the mandril at each station would affect the location of the fold. Moreover, by providing score lines having particular profiles, the folded envelope will have a predefined interior clearance for the disk media.

In the preferred embodiment, the disk media is inserted into a partially folded envelope jacket, and the jacket is sealed along all edges prior to detachment. Such disk insertion is made possible by the elimination of the mandril used by prior art folding systems. The method and system are also useful for fabricating partially-folded jackets which are detached and transferred to a conventional end folder for disk insertion and sealing.

By retaining the envelope blanks on the continuous web during folding, several advantages are realized. First, advancement of the envelope blanks is facilitated as the web may be drawn forward by its edges. Second, the need to manipulate individual envelopes is eliminated until the folded envelopes are complete and detached from the web. Finally, proper alignment of the envelope blanks is assured at all times by the advancement mechanism which engages the edges of the web through precisely located registration holes.

DESCRIPTION OF THE PREFERRED EMBODIMENT

Figure 1:
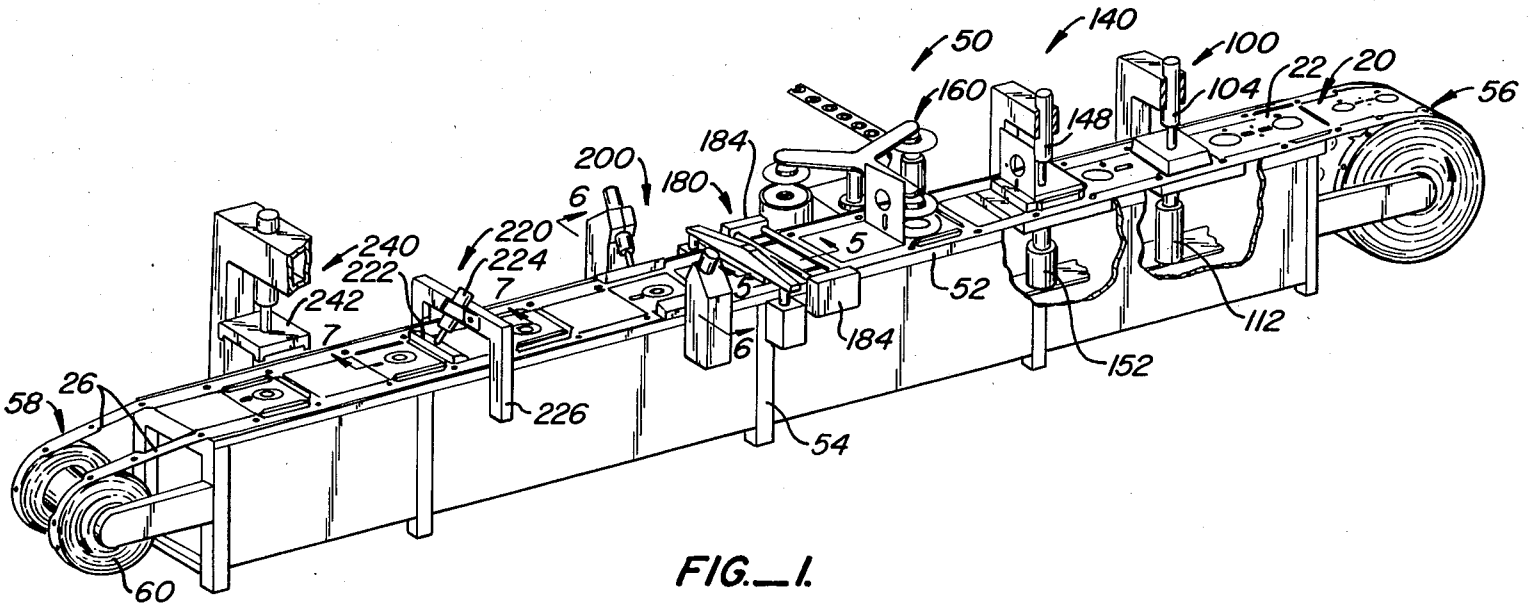
FIG. 1 is an isometric view of the envelope folding system of the present invention.

According to the present invention, a continuous web 20 (illustrated in detail in FIG. 9) of individual envelope blanks 22 is advanced along a linear path having a plurality of work stations located therealong. Folding, sealing, and disk insertion operations are performed at the work stations, and the final product of the operations is a ready-to-use floppy disk package.

The envelope blanks 22 (FIG. 9) are formed in the continuous web 20 by a plurality of shear lines 24 which fully penetrate the web material. The envelope blanks 22 remain attached to side trim 26 by means of six attachment points 28 for each blank 22. The attachment points are short segments (approximately 1/16" along the shear lines 24 where the web material has not been sheared. Four of the attachment points (designated **28*a*) are located at each corner of a primary flap 30 of the envelope blank 22, while the remaining two attachment points (designated 26*b*) are located along the edges of a secondary flap 32. As will be explained in detail hereinafter, the corner attachment points 28*a* remain intact during the entire folding operation of the present invention. The location of these attachment points is critical in that the secondary flap 32 may be folded over along fold line 34 (illustrated in broken line) without breaking the attachment points 28*a*, and at least two of the attachment points 28*a* will be required to hold the partially-cut envelope 22 in place. Similarly, side sealing flaps 36 may be folded along fold lines 38 and end sealing flap 40 may be folded along fold line 42 without breaking attachment points 28*a*. Attachment points 28*b*, in contrast, will be purposely broken during the preliminary folding operation, as described in detail hereinafter, when secondary flap 32** is folded upward.

Side trim 26 of the continuous web 20 includes a plurality of registration holes 44 which are utilized for advancing and aligning the web 20. Each envelope blank 22 further includes a plurality of holes necessary for functioning of the floppy disk. Of interest here are spindle holes 46 and read/write holes 48.

Referring now to FIG. 1, a folding system 50 constructed in accordance with the present invention comprises a support table 52 mounted on a freestanding frame 54. The envelope blanks 22 on continuous web 20 are fed from a spool 56 to the inlet end (to the right in FIG. 1) of the support table 52. The web 20 is advanced along the upper surface of support table 52 by a web drawing means such as an uptake spool 58 (or equivalent means, such as a grip-and-pull strip feeder or nip roll means) which collects the side trim 26 which remains after the envelope blanks 22 have been folded and removed from the continuous web 20. The web draw means 58 is intermittently driven to incrementally translate the web 20 so that the envelopes are successively advanced from station to station.

To assure proper alignment of the web at each station, reciprocatable alignment pins 64 (see FIGS. 2–5 and 8) are provided in the table 52. The pins 64 are driven by a lever 66, cam (not illustrated), or quivalent means for extending and retracting the pins through openings 68 in table 52. While the web 20 is advanced, the pins 64 remain retracted in the recess formed by openings 68 so that there is no interference. When the web 20 is fully advanced to the next position, however, levers 66 are actuated (by means not illustrated) to raise the pins 64. The upper ends of pins 64 are tapered and thus act to precisely align the envelope blank 22 at the work station.

As the continuous web is advanced along the support table 52, a series of operations are performed on the partially-cut individual envelope blanks 22 in order to fold the blanks, insert the disk media, and seal the folded envelopes along their edges. The first station illustrated at 100 (FIGS. 1 and 2) is the scoring station where a plurality of score lines are simultaneously inscribed along the fold lines 34, 38 and 42 illustrated in FIGS. 2 and 9.

Figure 2:
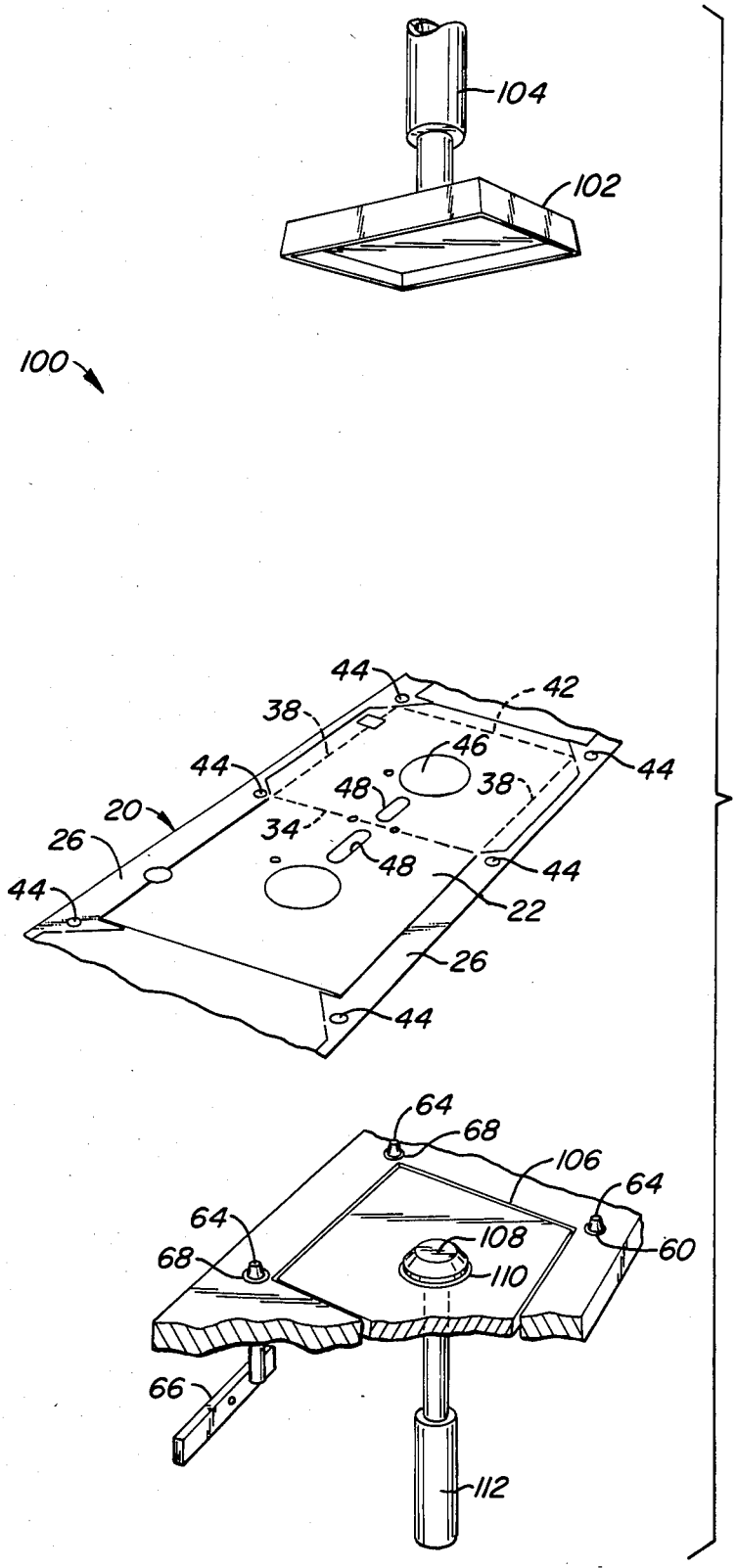
FIG. 2 is an exploded view of the scoring mechanism of the folding system of the present invention.

Referring in particular to FIG. 2, the scoring or embossing station 100 includes a score blade 102 which is mounted to vertically reciprocate in ram 104. The score blade 102 mates with line cavities 106 located in the upper surface of table 52. Both the score blade 102 and the line cavities 106 are precisely dimensioned to inscribe fold lines 34, 38 and 42 when the envelope blank 22 is positioned at scoring station 100. An opening 110 is formed in the support table 52 to accomodate an aligning plug 108 mounted on stroking ram 112. When elevated, plug 108 engages spindle hole 46 in blank 22 to insure proper alignment of the blank during the scoring operation. Such alignment is in addition to the operation of the alignment posts 64 described hereinbefore. Optionally, an additional alignment plug (not illustrated) may be provided to engage read/write hole(s) 48.

After the aligning plug 108 has engaged the spindle hole 44 of envelope blank 22, the score blade 102 will be lowered to press the envelope blank against line cavities 106 formed in the upper face of table 52. Conveniently, the score blade 102 will be heated to facilitate forming the folding scores in the plastic web material.

As just described, the fold lines 34, 38 and 42 are precisely imparted to the envelope blank. While the folding operation will be completed at one or more subsequent stations, the lines along which the folds will form have been fixed at the scoring station 100. Thus, even if the jacket becomes slightly misaligned at the later folding stations, the accuracy of the folds and dimensions of the final jacket will not be affected.

Although a stamping operation as just described is preferred for simultaneously inscribing score lines in the envelope blank, other operations could also be employed. For example, a rolling die could be employed with a mating die cavity in a conventional manner.

A wide variety of score profiles are suitable for use on the envelope blanks 22 of the present invention. A number of these score profiles are illustrated in FIGS.

Figure 10A:
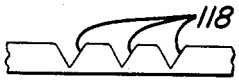
FIGS. 10–16 illustrate different score profiles which may be inscribed in the envelopes at the scoring station to facilitate subsequent folding.
Figure 10B:
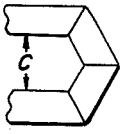

10 through 16. These illustrations are shown in pairs, with the A illustration showing the score profile prior to folding and the B illustration showing the profile subsequent to folding. The score profile illustrated in FIGS. 10A and 10B may be imparted by cold embossing with three "V" notches 118 of 30° to a depth ranging from approximately 50 to 90% of the material thickness. When folded, the "V" notch closes to form a butted joint with folding of approximately 180°. A fixed clearance "C" is provided to allow for rotation of the disk media in the folded jacket.

Figure 11A:
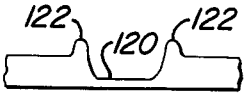
Figure 11B:
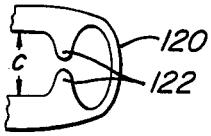

The fold profile of FIGS. 11A and 11B will be formed by thermally embossing the web material to define a thin section 120 which allows easy folding. Mounds 122 which are formed around the thin section 120 will meet when the material is folded to provide a minimum clearance "c" between the two folded faces which allows for rotation of the disk media in the folded jacket.

Figure 12A:
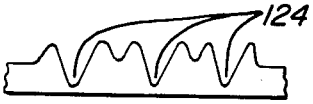
Figure 12B:
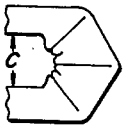

Referring to FIGS. 12A and 12B, "V" notches 124 (similar to notches 118 illustrated in FIGS. 10A and 10B) may be formed thermally to provide a clearance "C", as described previously. Thermal forming of the notches is a benefit in that it helps relieve stress in the fold area and increases the area of the mating surfaces.

Figure 13A:
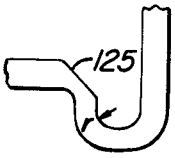
Figure 13B:
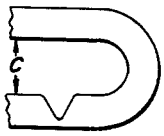

A die-formed edge may be formed as illustrated in FIGS. 13A and 13B. The web material is hot stamped to form the profile illustrated in FIG. 13A. The resulting fold is illustrated in FIG. 13B. The radius "r" in the U-shaped section of the profile defines the clearance "c" in the completed fold (FIG. 13B). The beveled edge 125 acts as a hinge when the envelope is eventually folded into its final configuration.

Figure 14A:
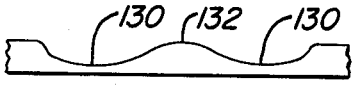
Figure 14B:
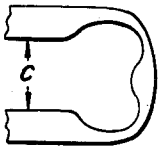

FIGS. 14A and 14B illustrate a fold profile which is formed by thermally embossing two recessed areas 130 along the fold line. Section 132 between the recesses 130 defines a clearance "C" between the folded faces after folding.

Figure 15A:
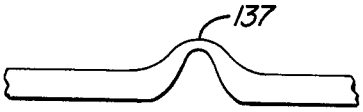
Figure 15B:
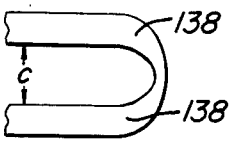

The score line of FIGS. 15A and 15B may be formed by cold or thermal embossing. The thinned section 137 defining score line allows the fold to be accomplished with a thicker, molded radius 138 on each side, defining clearance "C" between the folded faces.

Figure 16A:
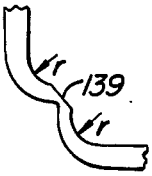
Figure 16B:
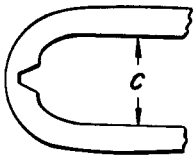

The score lines of FIGS. 16A and 16B are formed by hot stamping in a manner similar to those of FIGS. 13A and 13B. The radii "r" together determine the final clearance "C" after the flaps are folded over hinge region 139.

The score profiles of FIGS. 13, 15, and 16 are preferred since the radius portions of the score lines define the thickness of the floppy disk envelope, while the hinge portion precisely define the fold line.

Figure 3:
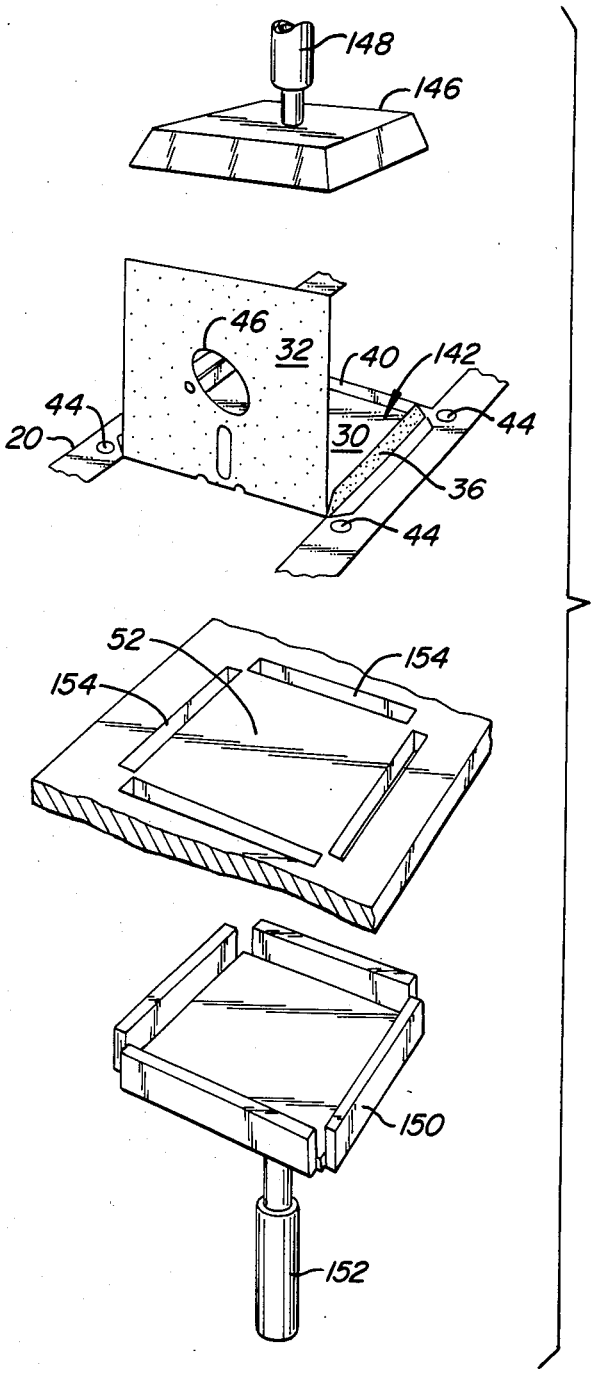
FIG. 3 is an exploded view of the preliminary folding station of the folding system of the present invention.
Figure 9:
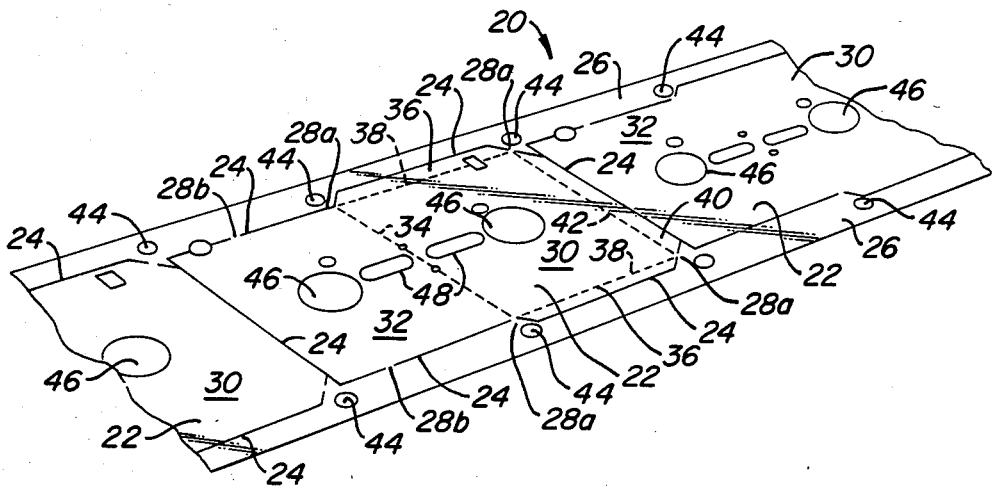
FIG. 9 illustrates a portion of the continuous web which includes the individual envelope blanks.

Referring now to FIGS. 1 and 3, the preliminary folding station 140 will be described. The first folding station 140 imparts an approximately 90° fold to each of the secondary flap 32, side flaps 36, and end flap 40. The folds are made along fold lines 34, 38, and 42, as illustrated in FIG. 9. The folded flaps 32, 36 and 40 form a receptacle or cavity 142 in the form of a shallow, open box having the primary flap 30 as its base. The receptacle 142 receives disk media prior to complete folding of the envelope 22, as will be described hereinafter.

The first folding station 140 as described in FIG. 3 comprises a clamping mandril 146 which is reciprocatably mounted on a ram 148. The ram 148 can lower the clamping mandril 146 until it engages the upper surface of support table 52. In this way, the primary flap 30 of envelope blank 22 may be held in place as folding blades 150 are raised by ram 152. The folding blades 150 project through clearance slots 154 in the support table 52.

Because of the score lines (which were formed in the envelope blank 22 at scoring station 100), the clamping mandril 146 does not define the fold lines which are formed in the envelope. Instead, the clamping mandril 146 is somewhat smaller than the primary flap 30, while the folding blades 150 are spaced slightly outward from the fold lines. In this way, the folds are formed precisely along the previously inscribed fold lines as the folding shears 150 are raised.

In some instances, it will be desirable to combine the scoring station 100 and preliminary folding station 140 into a single station where the fold lines 34, 38 and 42, are inscribed and the initial 90° completed. This is particularly true when the score profiles illustrated in FIGS. 13 and 16 are utilized. The hot stamping inherently accomplishes the first fold in the scoring operation.

Figure 4:
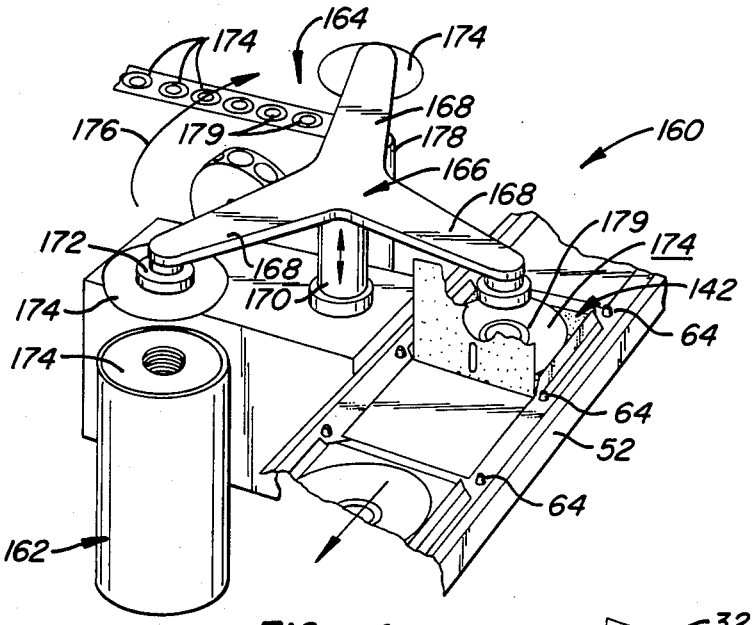
FIG. 4 is a schematic view of the disk insertion station of the folding system of the present invention, including apparatus for application of hub rings to individual disks.

The partially folded envelope blanks 22 are advanced from primary folding station 140 to disk insertion station 160 illustrated in FIGS. 1 and 4. The disk insertion station 160 includes a disk supply stack 162 and hub and ring supply assembly 164, and transfer arm assembly 166. The transfer arm assembly 166 includes three radial transfer arms 168 which are mounted on a reciprocatable shaft 170. Each arm includes a disk manipulator 172 at its outer radial end. The disk manipulator is able to selectively attach and detach individual disks 174 by means of a vacuum pick-up. Thus, an arm 168 is able to pick up a single disk 174 from the disk supply bin 162 by lowering the disk manipulator 172 to contact the disk 174, and thereafter raising the disk manipulator to remove a single disk from the stack 162. After securing and elevating the disk 174, the transfer arm assembly 166 is rotated clockwise (arrow 176) until the disk is at the hub ring supply assembly 164. There, hub ring attachment mechanism 178 will apply a hub ring 179 around the spindle hole of the disk. The transfer arm assembly 166 is then further rotated in a clockwise direction until the disk is located above cavity 142 of the partially folded envelope 22 which has arrived at the insertion station 160. The transfer arm assembly 166 is again lowered and the disk 174 is detached from the disk manipulator 172 and deposited in the cavity 142 of the envelope 22.

Figure 5A:
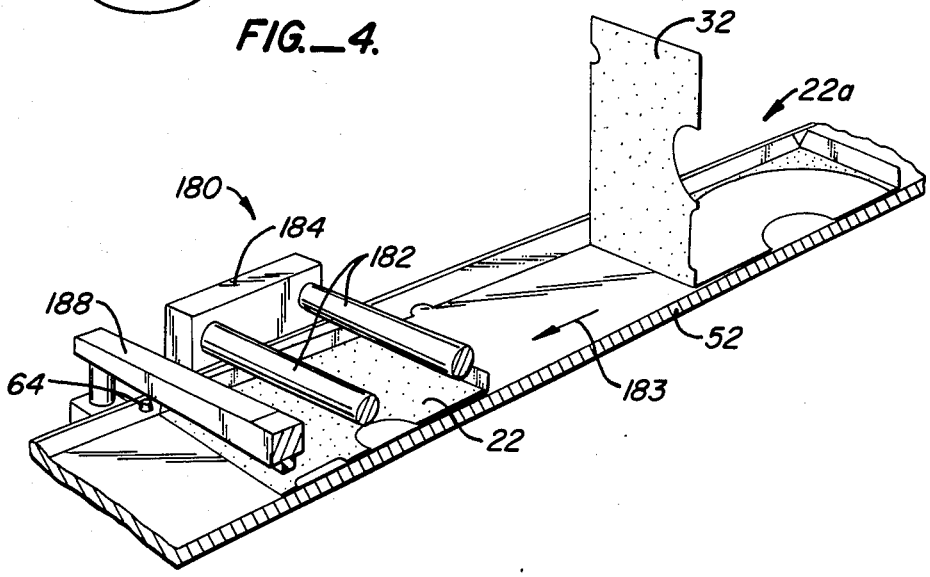
FIGS. 5A–5C schematically illustrate the operation of the transverse folding station of the folding system of the present invention.
Figure 5B:
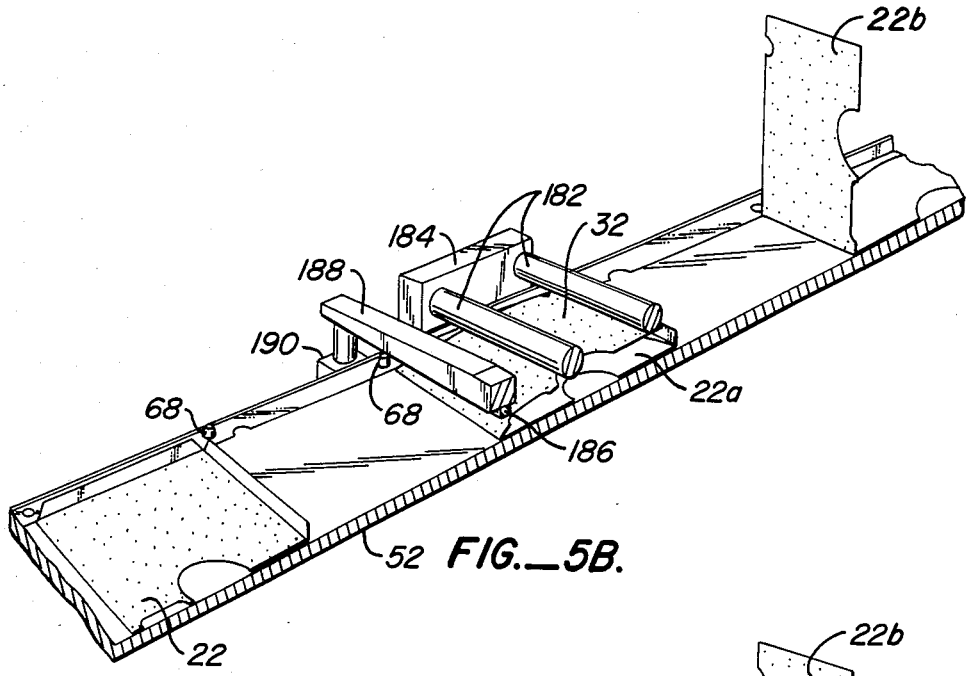
Figure 5C:
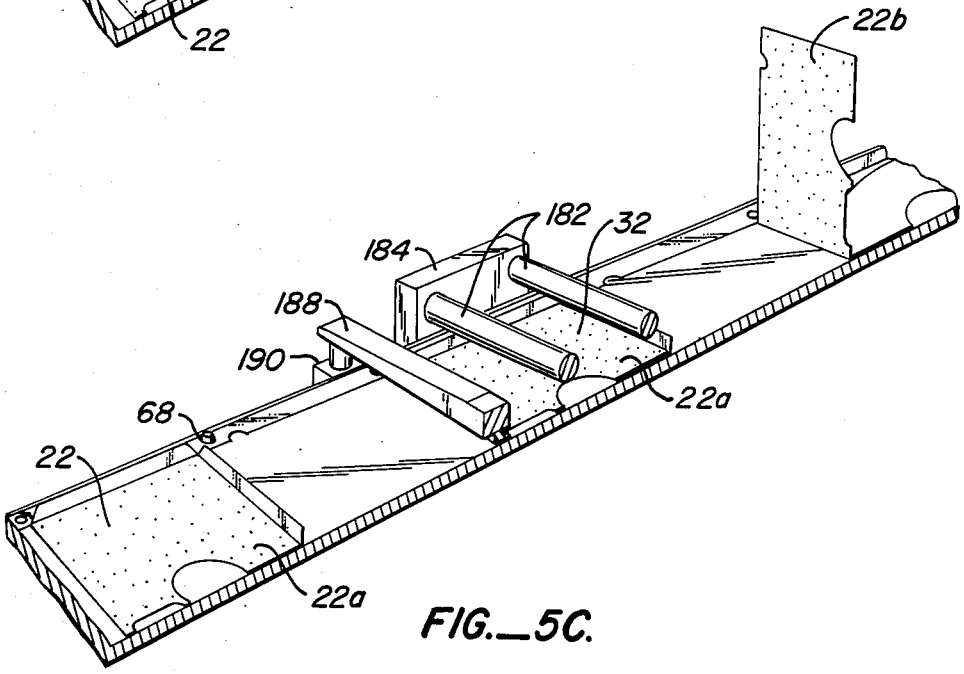

After disk insertion, arm 168 is raised, and the partially folded envelope blank 22 is advanced to transverse folding station 180. Referring to FIGS. 1 and 5A–5C, transverse folding station 180 includes one or more of folding bars 182 which are secured at either end in support brackets 184. The support brackets 184, in turn, are mounted on opposite sides of the support table 52. The folding rods 182 are fixed in place and mounted transversely across support table 52. Thus, as a partially folded envelope 22 (FIG. 5A) is advanced to the left (arrow 183), secondary flap 32 which is projecting upward, engages the folding rods 182. The folding rods 182 fold secondary flap 32 downward until it reaches the position shown in FIG. 5B. The advance mechanism is stopped at this position and a resilient folding bar 186 is lowered onto the fold line 42 (FIG. 9), as illustrated in FIG. 5C. Resilient folding bar 186 is mounted on a transverse support bar 188 which in turn is mounted on vertically reciprocatable rams 190 secured to either side of the support table 52.

Figure 6A:
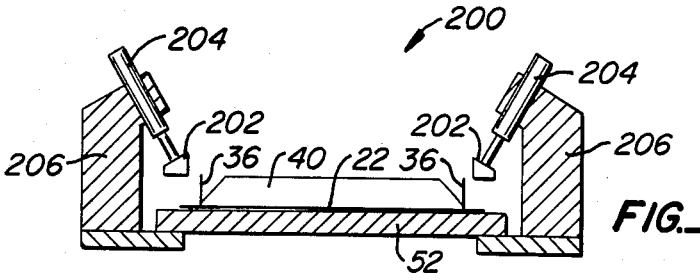
FIGS. 6A and 6B schematically illustrate the operation of the side flap folding mechanism of the folding system of the present invention.
Figure 6B:
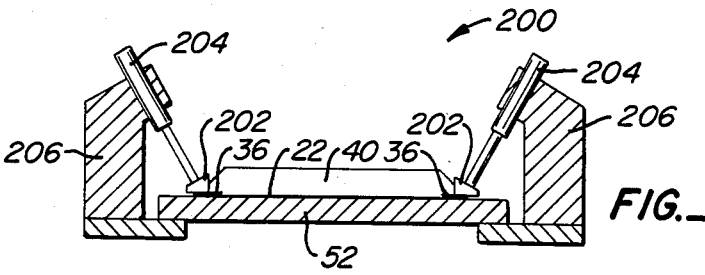

After folding the secondary flap 32, the envelope 22 is advanced to the side flap folding station 200, illustrated in FIGS. 6A and 6B. The side flap folding station includes folding bars 202 mounted on rams 204. The rams 204, in turn, are mounted on bracket assemblies 206 so that one folding bar 202 is on each side of the support table 52. The folding bars 202 are located so that they lie adjacent the upper end of side flaps 36 when the rams 204 are in their retracted position. The rams 204 are mounted at such an angle so that the folding bar 202 will engage the side flaps 36 near the middle and complete the fold of the side flap as the rams 204 are extended, as illustrated in FIGS. 6B. The folding bars 202 are then retracted and the envelope 22 is ready to be advanced to the next station.

Figure 7A:
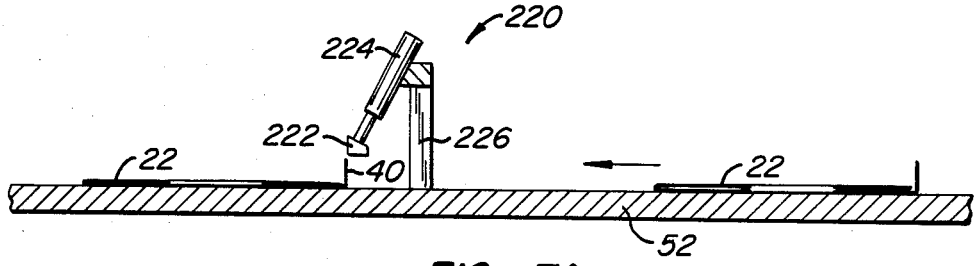
FIGS. 7A and 7B schematically illustrate the operation of the end flap folding mechanism of the folding system of the present invention.
Figure 7B:
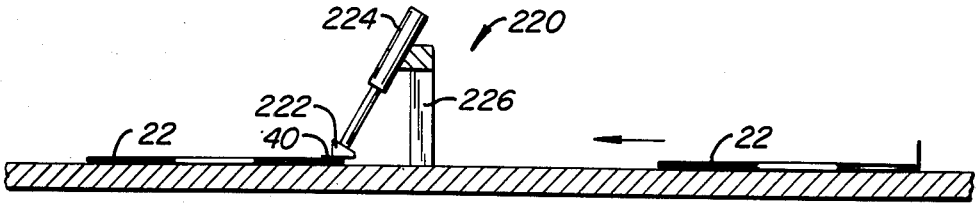

The envelopes 22 are next advanced to the end folding station 220, as illustrated in FIGS. 7A and 7B. The end folding station 220 comprises a single folding bar 222 mounted on a ram 224. The ram 224, in turn, is mounted on a support frame 226 which is attached on either side of support table 52. In this way, the ram is suspended over the center of the support table 52, and the folding bar 222 is located across the support table 52. As the envelopes 22 are advanced, they come to rest with end flap 40 lying immediately forward (to the left) of the folding bar 222, as illustrated in FIG. 7A. The ram 224 is then extended, and the folding bar 222 moves downward to fold the end flap 40 over, as illustrated in FIG. 7B. The folding of the envelope is then complete.

Frequently, it will be desirable to incorporate side flap folding station 200 and end flap folding station 220 into a single station. The stations 200 and 220 have been shown separately in order to faciliate description and illustration .

In addition to the work stations described thus far, it will sometimes be necessary to add a sealing station. Sealing of the folded envelopes may be accomplished by providing pressure sensitive adhesives on the flaps 36 and 40, in which case the flaps will be sealed when the folding is accomplished at stations 200 and 220 (requiring no additional work station). Sealing may also be accomplished by heat-staking which will require additional heat-staking apparatus. Such heat staking apparatus is well known in the art, and may be installed in a separate station following end folding station 220. Alternativley, the sealing station may be mounted within the end folding station 220, or at a combination side flap and end flap folding and sealing station.

Figure 17:
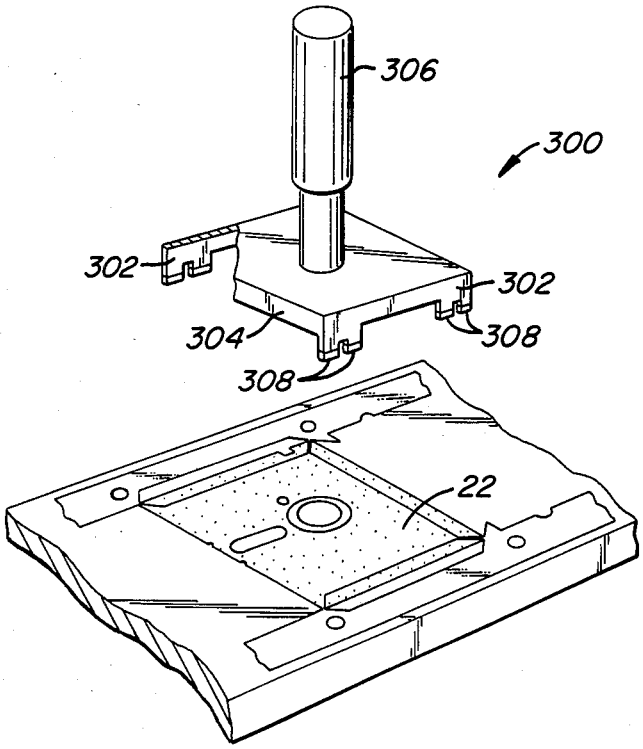
FIG. 17 is a schematic view of the heat stake station of the folding system of the present invention.

A suitable heat staking station is illustrated at 300 in FIG. 17. The heat staking station 300 includes three heat stake blades 302 (only two of which are illustrated) mounted on reciprocatable plate 304. The reciprocatable plate 304, in turn, is reciprocatably mounted on a ram 306 so that heated tips 308 on the blades 302 may be lowered into contact with a folded envelope 22 which has been advanced to a position on support table 52 directly below the plate 304. The tips 308 are electrically heated to a temperature sufficient to melt the PVC envelope material so that the flaps 34 and 36 are melted onto the underlying face of the envelope. Heat is applied for a time sufficient to melt the PVC. After melting, the heat is removed, but the reciprocatable plate is not raised until the melted areas of the envelope have cooled and hardened.

Also, it may sometimes be beneficial to provide an annealing station to relieve stress in the jacket resulting from the folding. Annealing is accomplished by clamping the jacket flat against the table 52 and applying heat to the folded edges of the jacket.

Figure 19:
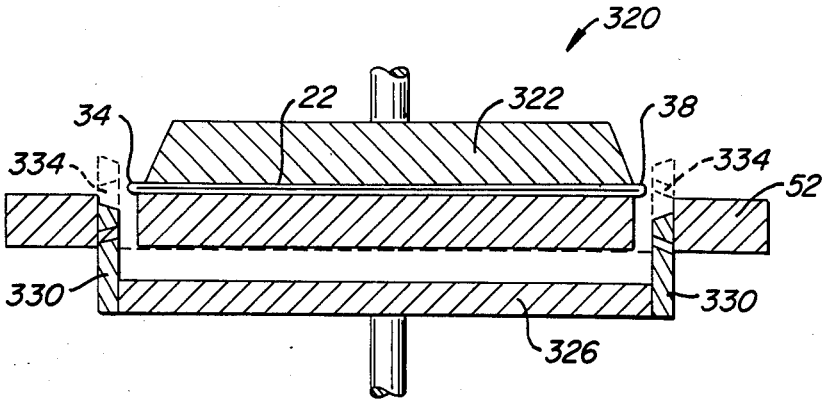
FIG. 19 is a cross-sectional view of the annealing station of the folding system of the present invention.
Figure 18:
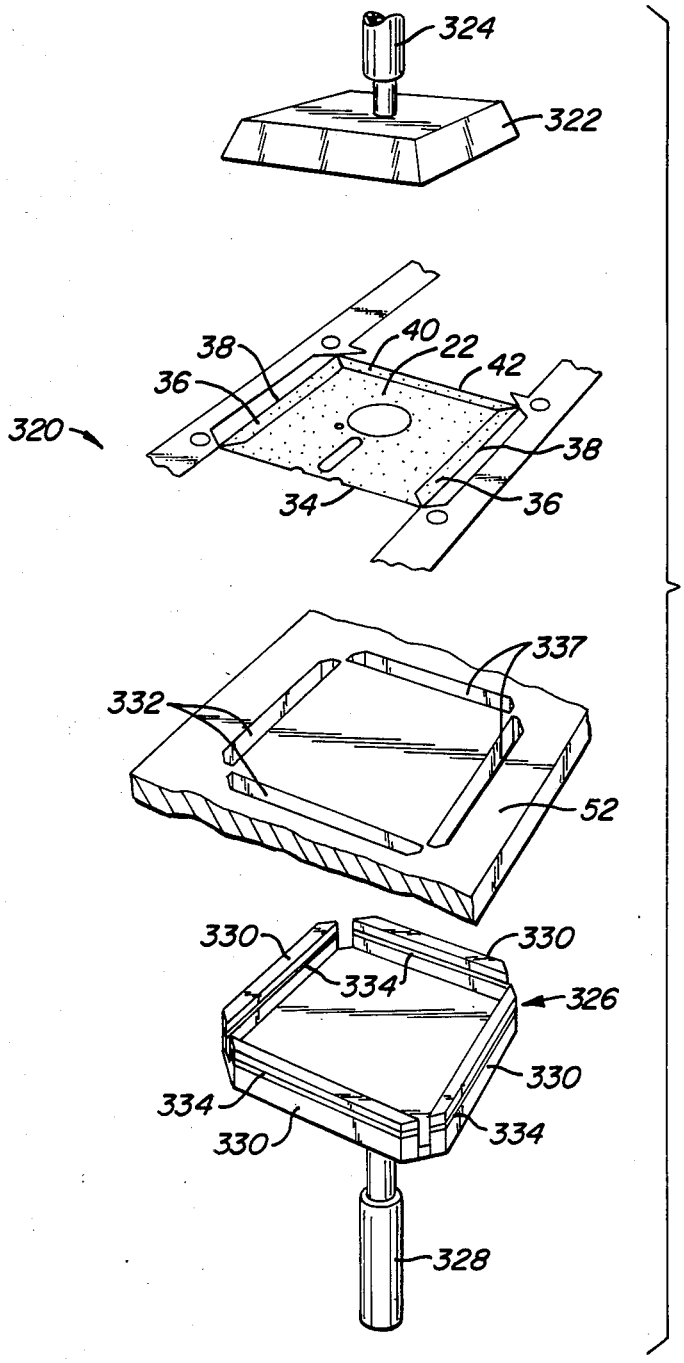
FIG. 18 is an exploded view of the annealing station of the folding system of the present invention.

A suitable annealing station is illustrated in FIGS. 18 and 19. The folded envelope 22 is advanced to annealing station 320 along support table 52. The annealing station 320 comprises a clamp member 322 which is reciprocatably mounted in ram 324 over table 52. A radiant heat member 326 is reciprocatably mounted in ram 328 beneath table 52. Radiator bars 330 are attached at the periphery of the radiant heat member 326 so that they will extend through slots 332 in Table 52 when elevated. As best illustrated in FIG. 19, radiant elements 334 located in each radiator bar 330 are positioned adjacent the fold lines 34, 38 and 42 when the member 326 is in its fully raised position (as illustrated in broken line).

To anneal a folded envelope 22, the envelope is advanced to annealing station 320 while clamp member 322 is raised and radiant heat member 326 is lowered. As soon as the envelope 22 is properly positioned, the clamp member 322 is lowered, and radiator member 32 is raised. Heat is applied through the radiant elements 334 for a time and at a temperature sufficient to relieve stress in the folds. After heat application is stopped, the envelope 22 remains clamped while the folds cool. The envelope 22 may then be advanced to the next station, typically the detachment station 240.

Figure 8:
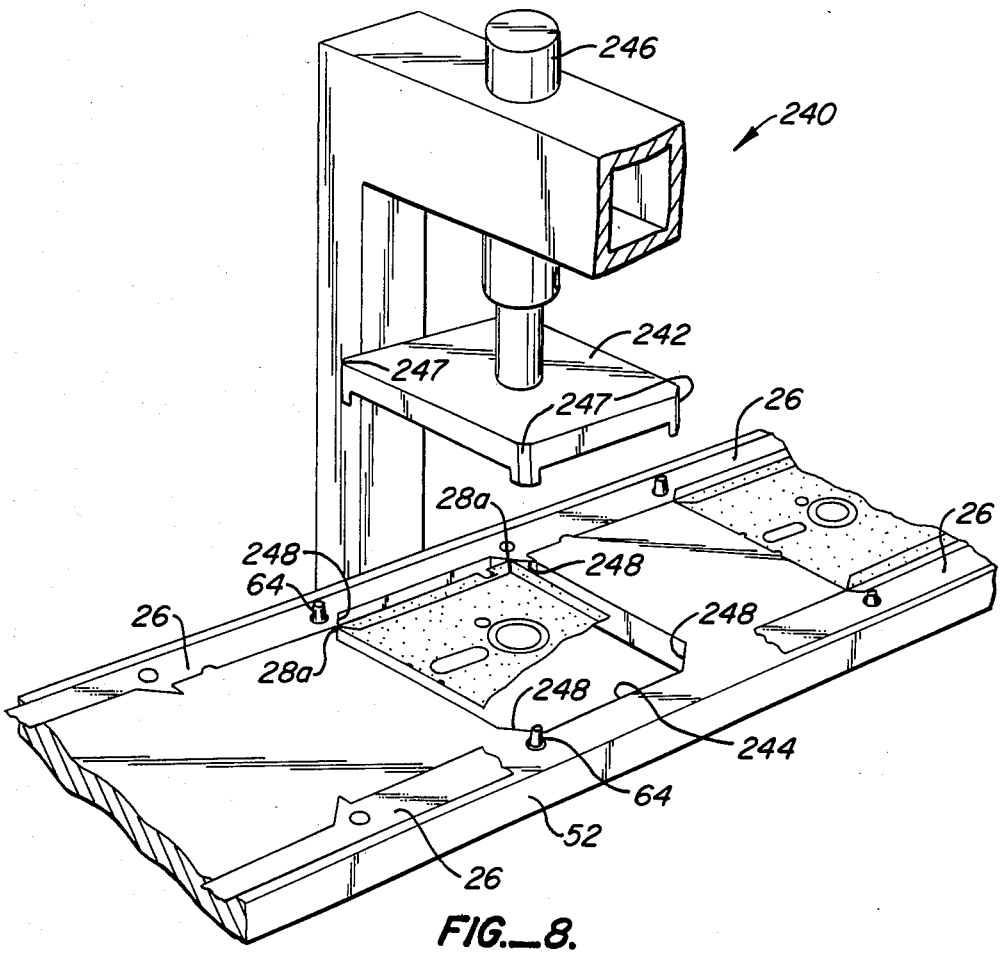
FIG. 8 is a simplified detail view illustrating the punch station of the system of the present invention.

The folded envelope is advanced from the end folding station 220 (or sealing station if employed) to detachment station 240, illustrated in FIG. 8. Detachment station 240 includes a punch member 242 which is aligned with opening 244 formed in the support table 52. The punch member 242 is mounted in a vertically acting ram 246 so that the punch member may reciprocate in and out of the receiving hole 244 formed in table 50. The four corners 247 of the punch member 242 are bevelled and aligned with the four corners 248 of the opening 244, resulting in a shearing action as the punch member 242 is lowered. The punch member 242 is thus able to sever the four attachment points **28*a* which hold the folded envelope 22 onto the side trim 26. The folded envelope is thus released from the side trim and falls downward through the opening 244** where it is collected.

Although the foregoing invention has been described in some detail by way of illustration and example for purposes of clarity of understanding, it will be obvious that certain changes and modifications may be practiced within the scope of the appended claims.

What is claimed is:

1. A method for folding flopping disk envelopes, said method comprising:

feeding a continuous web of envelope material along a predetermined path, said web including a plurality or partially-cut envelope blanks which comprise a primary flap joined to a secondary flap along a common edge transverse to said path and three sealing flaps joined to the other three edges of the primary flap;

folding at a first location on the path the secondary flap over against the primary flap along a fold line transverse to the path to form the envelope while the primary flaps of the folded blank and the upstream and downstream envelope blanks remain attached at their corners to bhe web;

folding and sealing at a second location on the path at least two of the sealing flaps over against the secondary flap along fold lines parallel to the path to seal those edges of the envelope while said primary flaps remain attached to said web; and detaching the folded, sealed envelope from the web at a third location along the path.

2. A method as in claim 1, wherein the secondary flap and sealing flaps are first folded upward to form a cavity and a disk is inserted into the cavity prior to completing the fold of the secondary flap.

3. A method as in claim 2, wherein the secondary flap and sealing flaps are completely, folded and sealed after inserting the disk and prior to detachment of the envelope from the continuous web.

4. A method as in claim 1, wherein the fold lines are scored in the envelope blanks along the edges of the first rectangular face prior to folding.

5. An improved method for folding floppy disk envelopes of the type wherein folded envelopes comprising primary flaps joined along common edges to secondary flaps, and sealing flaps adjoined to the primary flap, are transported along a path transverse to said common edges defined by a plurality of work stations, said improvement comprising transporting the envelopes transverse to said common edges while attached to a continuous web by a continuous side trim and folding the secondary flap along a fold line transverse to the path and the sealing flaps along fold lines parallel to the path while the primary flaps of the folded blank and the upstream and downstream blanks remains attached to the side trim of the web, and detaching the folded envelope after the desired folding is complete.

6. A system for folding floppy disk envelope blanks held on a continuous web by a pair of side trim strips, wherein said blanks comprise a rectangular primary flap joined to a secondary flaps along a common edge and at least two sealing flaps joined to other edges of said primary flap, said system comprising:

means for advancing the continuous web of floppy disk envelope blanks along a predetermined path;

means located along the path for folding the secondary flap of the envelope blank over against the primary flap along a fold line transverse to the path while the primary flap remains attached to the continuous web;

means located along the path for folding and sealing the sealing flaps of the envelope blank over against the secondary flap along fold lines parallel to the path while the primary flap remains attached to the continuous web; and means located along the path for detaching the folded, sealed envelope from the continuous web.

7. A system as in claim 6, further comprising means located along the path for inserting disk media into the envelope blank prior to folding of the envelope.

8. A system as in claim 6, further comprising means for simultaneously inscribing a pattern of four orthogonal score lines which delineate the primary, secondary, and sealing flaps prior to folding of any of those flaps.

* * * * *